US009750995B2

(12) United States Patent
Nally

(10) Patent No.: US 9,750,995 B2
(45) **Date of Patent: *Sep. 5, 2017**

(54) LAWN DART, LAWN DART CADDY AND TARGET

(71) Applicant: Eastpoint Sports Ltd., LLC, Succasunna, NJ (US)

(72) Inventor: Michael J. Nally, Succasunna, NJ (US)

(73) Assignee: Eastpoint Sports Ltd., LLC, Succasunna, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/949,258

(22) Filed: Nov. 23, 2015

(65) Prior Publication Data

US 2016/0074725 A1 Mar. 17, 2016

Related U.S. Application Data

(63) Continuation of application No. 14/039,070, filed on Sep. 27, 2013, now Pat. No. 9,192,837.

(60) Provisional application No. 61/706,568, filed on Sep. 27, 2012, provisional application No. 61/706,579, filed on Sep. 27, 2012, provisional application No. 61/706,573, filed on Sep. 27, 2012.

(51) Int. Cl.

| | |
|---|---|
| ***A63B 65/02*** | (2006.01) |
| ***A63B 71/00*** | (2006.01) |
| ***F42B 6/00*** | (2006.01) |
| ***A63B 71/06*** | (2006.01) |
| ***A63B 63/00*** | (2006.01) |
| ***F41J 3/00*** | (2006.01) |
| ***F41J 5/04*** | (2006.01) |
| ***A63B 67/00*** | (2006.01) |

(52) U.S. Cl.

CPC ..... *A63B 65/02* (2013.01); *A63B 67/00* (2013.01); *A63B 71/0036* (2013.01); *A63B 71/06* (2013.01); *A63B 71/0605* (2013.01); *F41J 5/042* (2013.01); *F42B 6/003* (2013.01); *A63B 63/007* (2013.01); *A63B 2207/02* (2013.01); *A63B 2225/50* (2013.01); *A63B 2225/54* (2013.01)

(58) Field of Classification Search

CPC ... A63B 63/00; A63B 71/0036; A63F 9/0204; A63F 2009/0282; F41B 5/06; F41J 3/00; F41J 5/04; F41J 5/041; F41J 5/042; F42B 6/003

See application file for complete search history.

(56) References Cited

U.S. PATENT DOCUMENTS 2,905,218 A * 9/1959 Smith ..... F41B 5/063 124/25.7
3,596,910 A * 8/1971 Rizzo ..... F42B 6/003 473/585

(Continued)

*Primary Examiner* — John Ricci
(74) *Attorney, Agent, or Firm* — Thomas J. Oppold; Larkin Hoffman Daly & Lindgren, Ltd.

(57) ABSTRACT

A safety lawn dart game including safety lawn darts, a caddy and targets. The lawn dart includes an elongated shaft, a plurality of flights extending outwardly from the shaft and a head assembly having a weighted, spring biased head portion. The target may include a target hoop or electronic target. The caddy carries and stores the safety darts and targets in a convenient manner to keep all of the game components together.

16 Claims, 14 Drawing Sheets

(56) References Cited

U.S. PATENT DOCUMENTS 3,749,402 A * 7/1973 Adickes ..... A63B 65/00 473/579
3,784,199 A * 1/1974 Chmela ..... F42B 6/003 273/398
3,982,762 A * 9/1976 Milicic ..... F42B 6/003 473/585
4,105,119 A * 8/1978 Cowan ..... F41J 3/02 206/459.1
4,216,968 A * 8/1980 Yeeda ..... F41J 5/04 200/5 A
4,635,940 A * 1/1987 Kelley ..... F41J 5/052 273/348.5
4,659,090 A * 4/1987 Kustanovich ..... G01L 1/144 273/376
4,887,822 A * 12/1989 Tsai ..... F42B 12/362 473/585
4,946,172 A * 8/1990 Wong ..... F42B 6/003 473/585
4,997,190 A * 3/1991 Chmela ..... F42B 6/003 473/585
5,029,873 A * 7/1991 Davis ..... F41J 5/056 273/376
5,112,062 A * 5/1992 Pratt ..... F42B 6/003 473/585
6,068,260 A * 5/2000 Dean ..... A63B 67/06 273/400
6,390,085 B1 * 5/2002 Stinson ..... F41B 5/066 124/25.7
7,874,947 B1 * 1/2011 Wolfinbarger ..... A63H 33/18 473/578
7,905,488 B2 * 3/2011 Fulgham ..... F41J 5/042 273/317
9,192,837 B2 * 11/2015 Nally ..... F42B 6/003
2002/0117804 A1 * 8/2002 Chou ..... F41J 5/044 273/371

* cited by examiner

LAWN DART, LAWN DART CADDY AND TARGET

CROSS-REFERENCE TO RELATED APPLICATIONS

This application is a continuation of U.S. application Ser. No. 14/039,070, filed Sep. 27, 2013, which claims the benefit of U.S. Provisional Patent Application No. 61/706,568, filed Sep. 27, 2012 and U.S. Provisional Patent Application No. 61/706,579 filed Sep. 27, 2012 and U.S. Provisional Application No. 61/706,573, filed Sep. 27, 2012.

BACKGROUND

In the original lawn dart game, the dart consisted of a pointed metal head or tip attached to an elongated shaft with outwardly extending flights or fins. The object of the game was to lob the dart in an underhand manner to try to stick the dart in the ground within a target consisting of a plastic hoop. Despite its popularity, the game was banned and removed from the market due to safety concerns.

The pointed metal tipped darts were replaced with various types of blunt headed "safety" darts which have met with limited success primarily because these blunt headed safety darts tend to bounce or skip on the ground whereas the darts of the original lawn dart game would stick in the ground when thrown, making the original game much more a skill game rather than luck-of-the-bounce with current blunt headed safety darts.

Accordingly there is a need for a lawn dart that has a blunt safety head but performs similar to the original pointed tip lawn dart so it does not bounce or skip when it lands.

There is also a for a target that can be used with safety darts and which can be used indoors or outdoors.

There is also a need for a caddy that may be used for carrying and storing the blunt headed safety darts and targets in a convenient manner and will keep all of the game components together.

DETAILED DESCRIPTION

Figure 1:
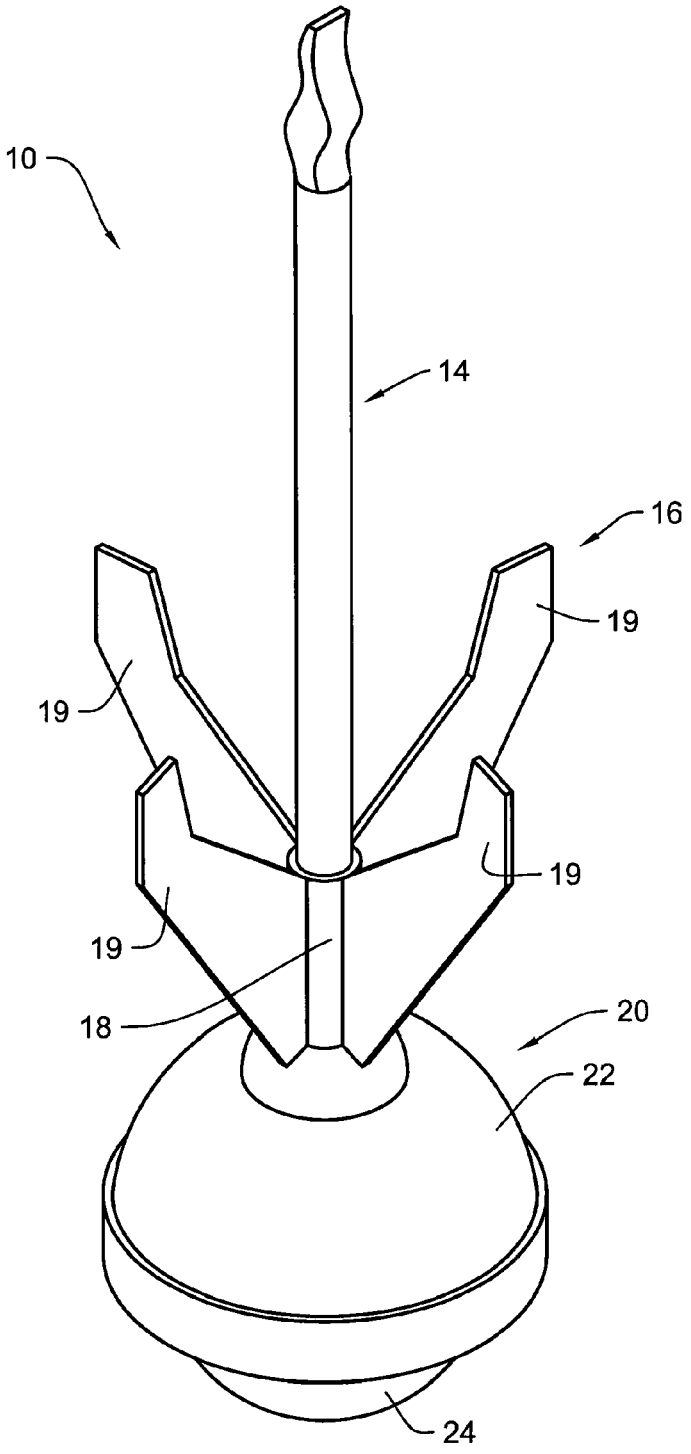
FIG. 1 is a perspective view of one embodiment of a lawn dart.

Referring now to the drawing figures, wherein like reference numerals designate the same or corresponding parts throughout the several views, FIG. 1 shows one embodiment of a lawn dart designated generally by reference numeral 10. The lawn dart 10 includes a head assembly 20, an elongated shaft 14 and flights 16.

The flights 16 may extend outwardly from a sleeve 18 secured to the shaft 14. The sleeve 18 may be fixed with respect to the shaft 14 or the sleeve 18 may be secured to the shaft 14 in a manner that may permit rotation and/or sliding of the sleeve 18 and flights 16 with respect to the shaft. Alternatively, the flights 16 may be formed integral with the shaft 14 or secured thereto in any suitable manner recognized by those skilled in the art.

Figure 4:
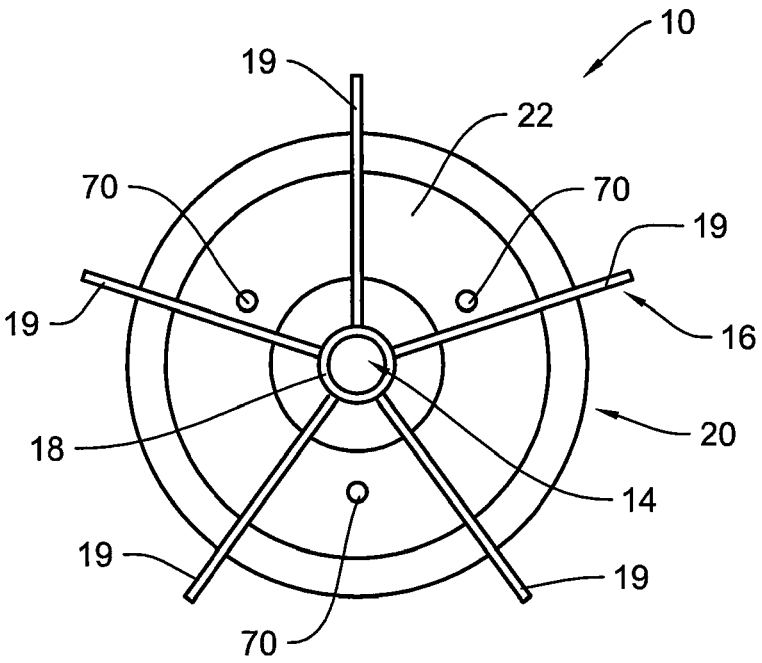
FIG. 4 is a top plan view of an embodiment of the lawn dart showing an embodiment of the dart flights.
Figure 5:
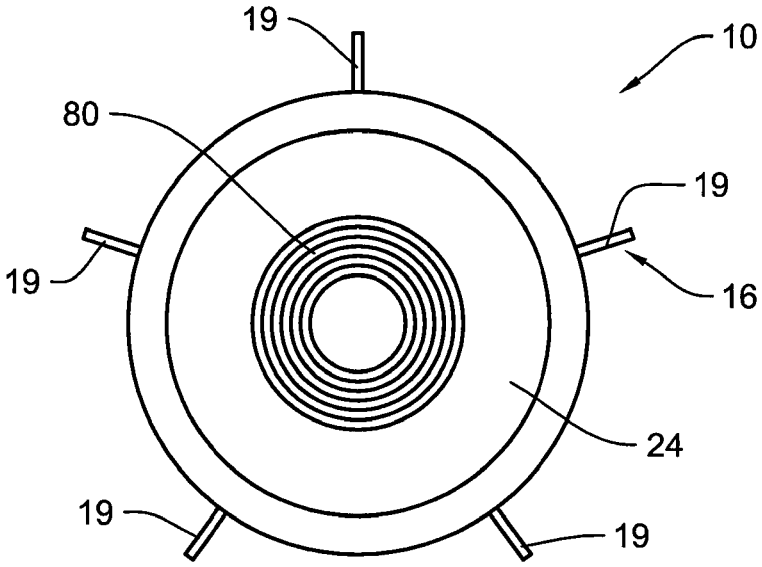
FIG. 5 is a bottom plan view of an embodiment of the bottom of the lawn dart.

As best illustrated in FIG. 4, the flights 16 include five equally spaced fins 19 projecting outwardly from the sleeve 18, but it should be understood that the number and configuration of the flights or fins may vary as desired from the embodiment illustrated.

The head assembly 20 is attached to one end of the shaft 14 and includes an upper head portion 22 and a lower resilient head portion 24. As illustrated in the embodiment of FIGS. 2-3A, disposed within the head assembly 20 is a weight 26 and a spring 28, the purpose of which will be described later.

Figure 2A:
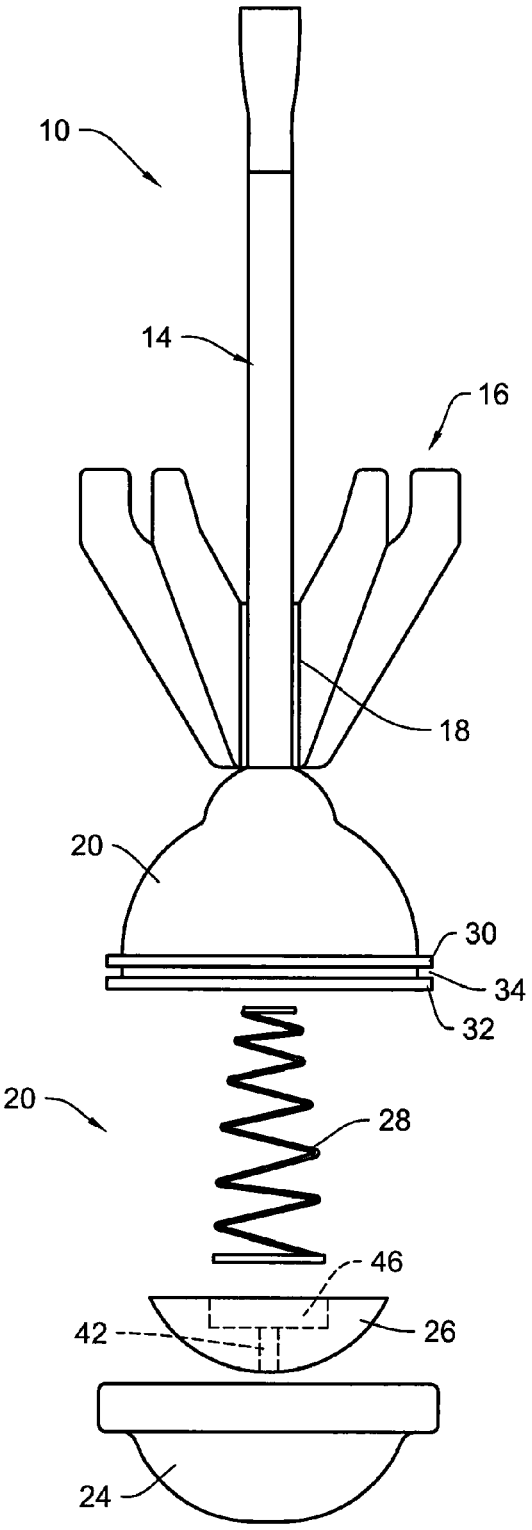
FIG. 2A is an exploded elevation view of the lawn dart of FIG. 1.

In the embodiment illustrated in FIG. 2A, the upper and lower head portions 22, 24 are substantially hemispherical, but other shapes or configurations may be equally suitable. The upper head portion includes outwardly projecting upper and lower circumferential ribs 30, 32 which define a circumferential channel 34. The lower resilient head portion 24 includes an upper circumferential flange 36 (FIG. 3A) and a inwardly projecting circumferential rib 38 (FIG. 3). When assembled, the upper circumferential flange 36 of the lower resilient head portion 24 extends over the upper rib 30 of the upper head portion 22 and the inwardly projecting circumferential rib 38 of the lower resilient head portion 24 is received within the complimentary circumferential channel 34 of the upper head portion 22. Thus, the flange 36 and the complimentary ribs and channels 30, 32, 34, 38 cooperate to secure the lower resilient head portion 24 to the upper head portion 22. It should be appreciated that other means of securing the upper and lower head portions together, as recognized by those of skill in the art, may be equally suitable.

Figure 3A:
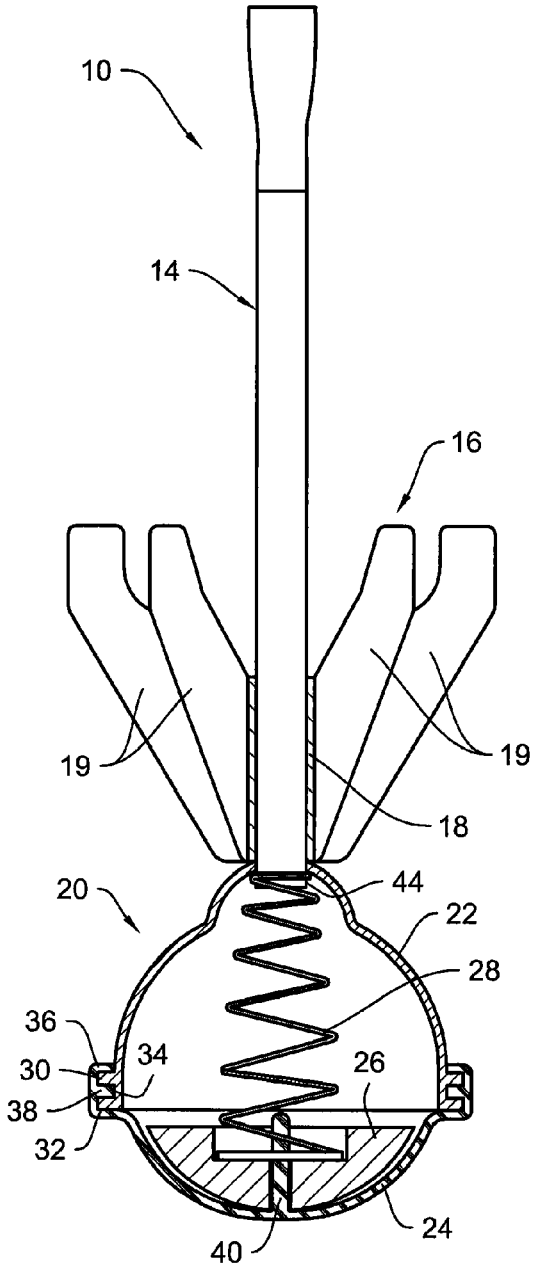
FIG. 3A is a cross-sectional view of the lawn dart of FIG. 2.
Figure 3B:
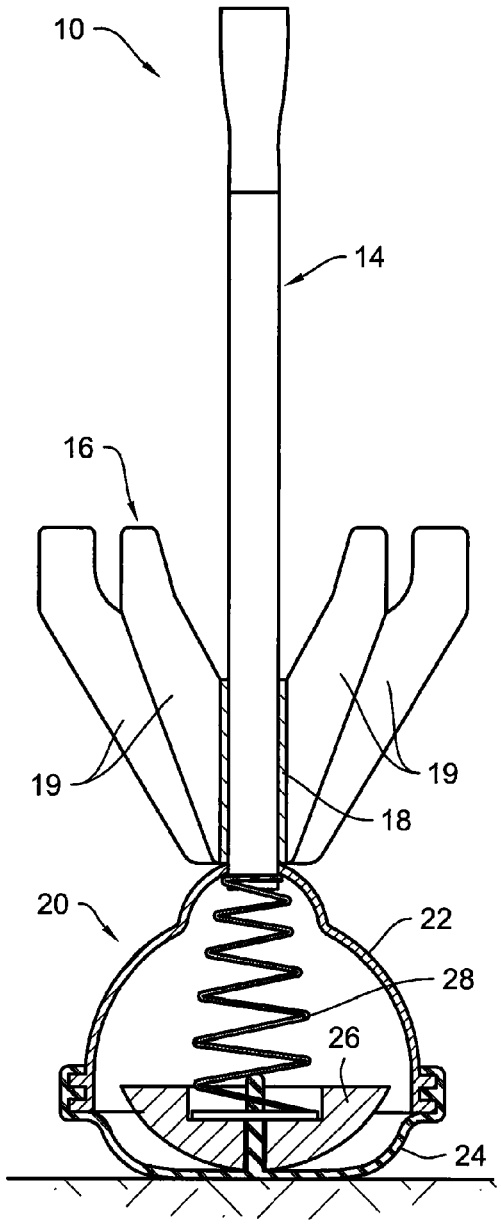
FIG. 3B is a cross-sectional view of the lawn dart of FIG. 3A but showing the bottom in the collapsed position as occurs on impact.

Continuing to refer to FIGS. 2A and 3A-3B, the weight 26 is disposed in the lower resilient head portion 24 and is preferably of sufficient mass such that when the dart is properly thrown in an underhand manner in a lobbed or arched trajectory, the mass causes the head assembly 20, and preferably the lower resilient head portion 24 to impact the ground or floor first. The weight 26 may be cast or formed of metal or it may comprise a granular or fluid filled pouch or other suitable component. The weight 26 may be retained in the lower head portion 24 by a stem 40 projecting upwardly from the inside of the lower resilient head portion 24 which is received within a bore 42 in the weight 26.

Figure 2B:
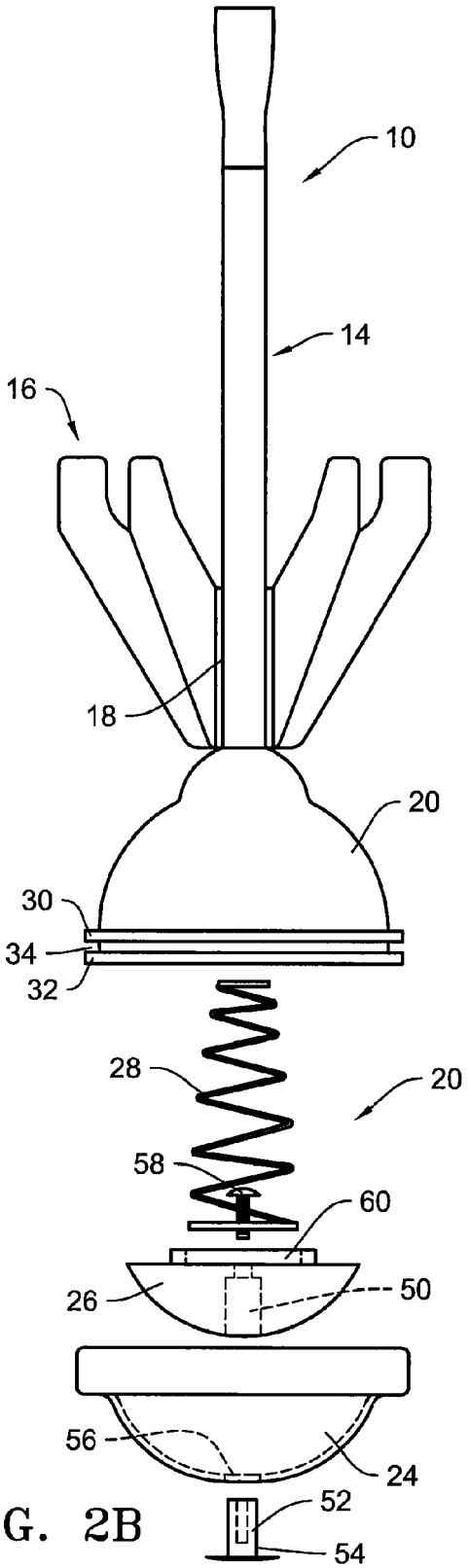
FIG. 2B is an exploded elevation view of an alternative embodiment of the lawn dart of FIG. 1.

The alternative embodiment of FIG. 2B is substantially identical to the embodiment of FIG. 2A except for the configuration of the weight 26 and the manner of securing the weight within the lower head portion 24. In the embodiment of FIG. 2B, the weight 26 includes a central counterbore 50 which receives the stem 52 of a plug 54 extending through an aperture 56 in the lower head portion 24. A threaded connector 58 is threadably received within the stem 52 securing the weight 26 to the plug 52 so as to ensure that the weight is restrained within the lower head portion 24.

As best illustrated in FIG. 3A-3B, the spring 28 is sized and positioned within the head assembly 20 to outwardly bias the weight 26 and the lower head portion 24 from the upper head portion 22 while still permitting the spring 28 to compress to absorb the impact of the ground or floor surface upon landing (FIG. 3B). One end of the spring 28 is retained in the upper head portion 22 by an inwardly projecting stub 44 of the shaft 12. The other end of the spring 12 is either received within a recess 46 of the weight 26 as illustrated in FIG. 2A or, alternatively, within a ring 60 of on the upper surface of the weight 26 as illustrated in FIG. 2B.

In use during game play, the lawn dart 10 is intended to be thrown at a target (described below) in an underhanded manner with a lobbed or arched trajectory. When properly thrown, the weight 26 in the head assembly 20 tends to cause the resilient lower head portion 24 of the head assembly to impact the ground or floor surface first. Upon impact with the ground or floor as illustrated in FIG. 3B, the spring 28, the weight 26 and resilient lower head portion 24 collapse or compress inwardly with respect to the upper head portion absorbing the impact, thereby causing the dart to substantially remain at the impact point without bouncing or skipping. Air holes 70 (FIG. 4), may be provided in the upper head portion 22 to permit air to escape from the head assembly 20 upon impact.

Figure 6:
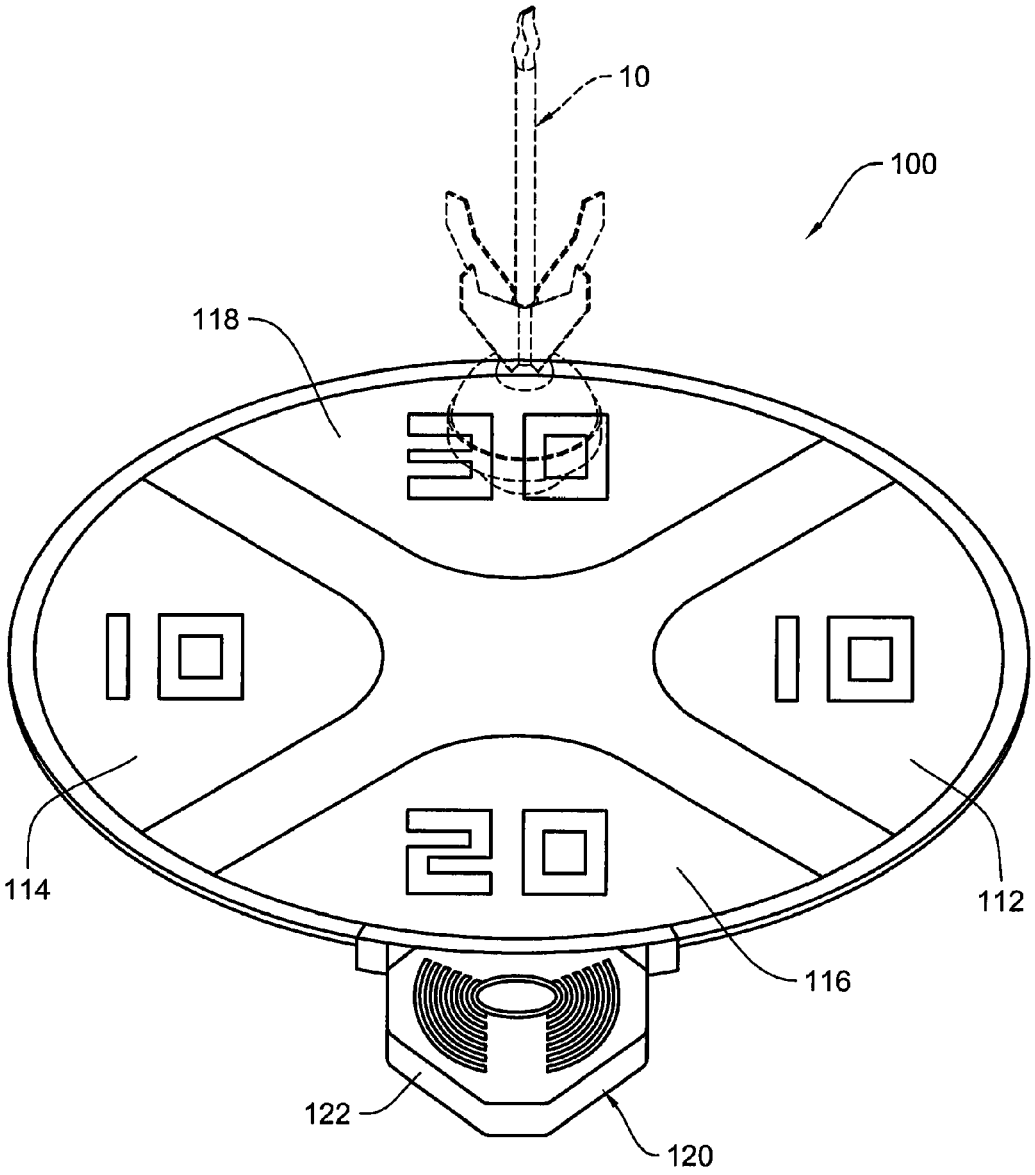
FIG. 6 is a perspective view of an embodiment of an electronic target.

As illustrated in FIG. 6, which is a bottom plan view of the resilient lower head portion 24, a series of concentric rings 80 or other suitable patterns may be molded into the resilient lower head portion 24 to permit the lower head portion 24 to better grip the surface to minimize sliding of the dart on impact.

Figure 12:
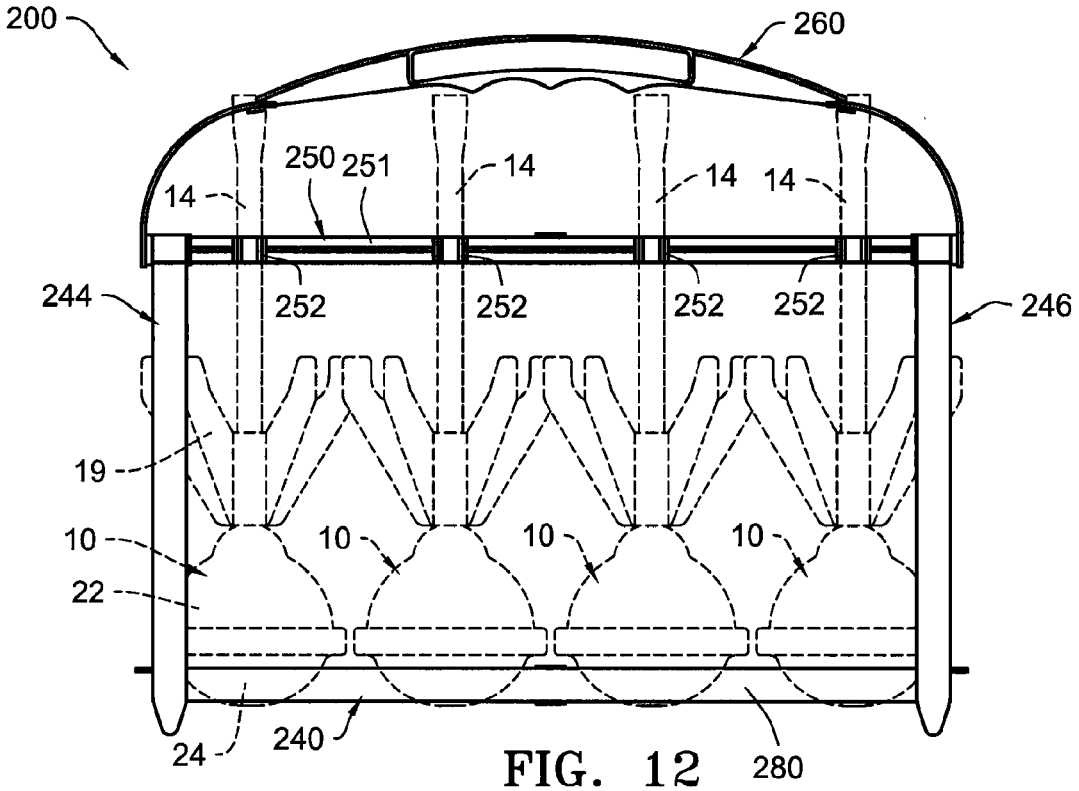
FIG. 12 is a front elevation view of the lawn dart caddy of FIG. 10, showing the lawn darts in hidden lines and with the target hoop removed for clarity.
Figure 13:
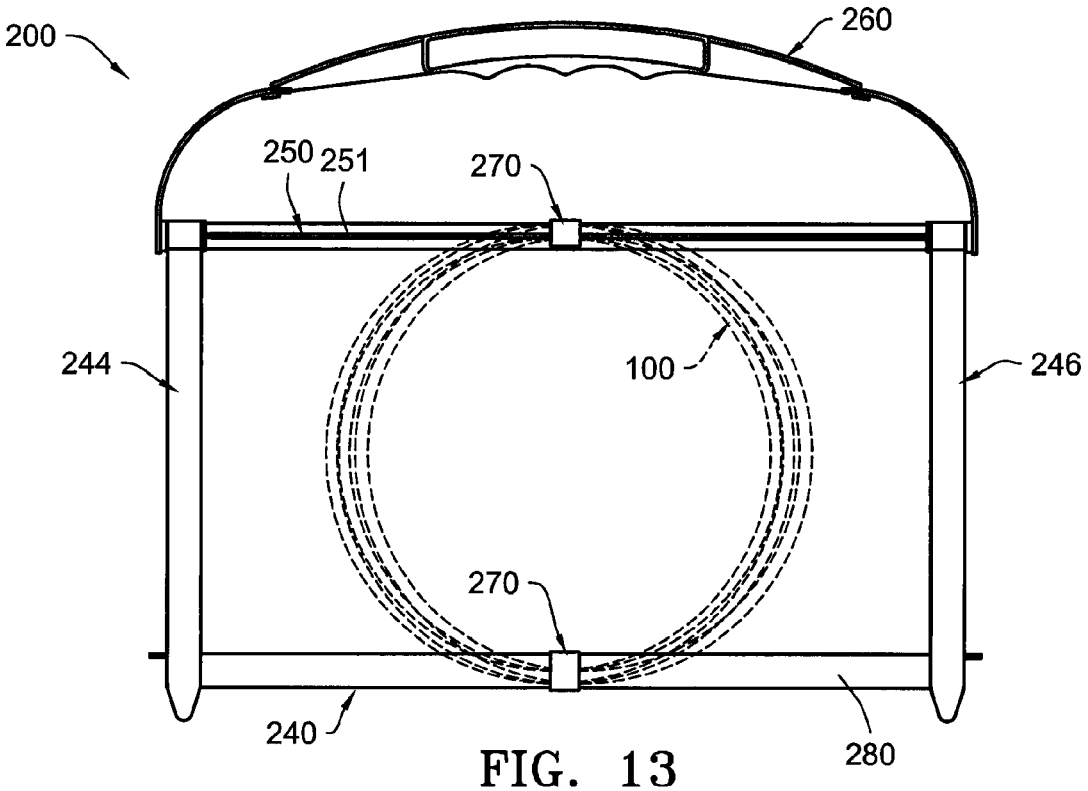
FIG. 13 is a rear elevation view of the lawn dart caddy of FIG. 10, showing the coiled target hoop in hidden lines and with the lawn darts removed for clarity.

The target 100 may comprise a simple plastic hoop substantially the same as used in the "old" dart game which used metal tipped darts. As in the "old" dart game the plastic hoop type target 100 may include a break line so that two ends forming the hoop can be pulled apart and coiled into small rings for storage as illustrated in FIGS. 12 and 13. Alternatively, the target 100 may comprise an electronic target as illustrated in FIG. 6.

FIG. 6 is a perspective view of an embodiment of an electronic target 100 for use in connection with a lawn dart game. In the embodiment illustrated, the electronic target 100 includes scoring areas with each scoring area associated with a point value. As illustrated, the electronic target includes two scoring areas 112, 114 associated with a "10" point value, one scoring area 116 associated with a "20" point value and a third scoring area 118 associated with a "30" point value. When the weighted, blunt headed lawn dart 10 lands on one of the scoring areas, a signal is generated to produce an audio output corresponding to the associated point value through a speaker within the housing 122 of the controller 120.

For example, when the dart 10 lands on the "30" point scoring area 118, the controller 120 will call out or verbalize the word "THIRTY". Similarly, if the dart 10 lands on the "20" point scoring area 116, the controller 120 will call out "TWENTY." Likewise if the dart 10 lands on either of the "10" point scoring areas 112, 114, the controller 120 will call out "TEN". It should be appreciated that the target 100 may include multiple scoring areas of different sizes, configurations and positions within the target and different points values may be associated with each of the scoring areas.

Additionally, the target 100 may comprise only a single scoring area with a single point value. In such an embodiment, if a dart impacts anywhere within the target an audio output is produced to simply indicate that the target was hit and a point or point value should be awarded to the thrower of the dart. The controller may generate a single sound or tone or a single verbalization of a word, such as, for example, "SCORE" to notify the player that the target was hit.

It should be appreciated that rather than an audio output, or in addition to an audio output, the electronic target 100 could incorporate lights, such as light emitting diodes (LEDs), of the same or different colors around each of the scoring areas, and/or around the entire perimeter of the target, which light up upon the dart impacting the scoring area(s) to produce a visual output. Alternatively, the visual output may include a display screen to visually display the point value of the scoring area that is hit by the dart, or, if the target comprises a single scoring area, the visual display may display, for example, the word "HIT."

Figure 7:
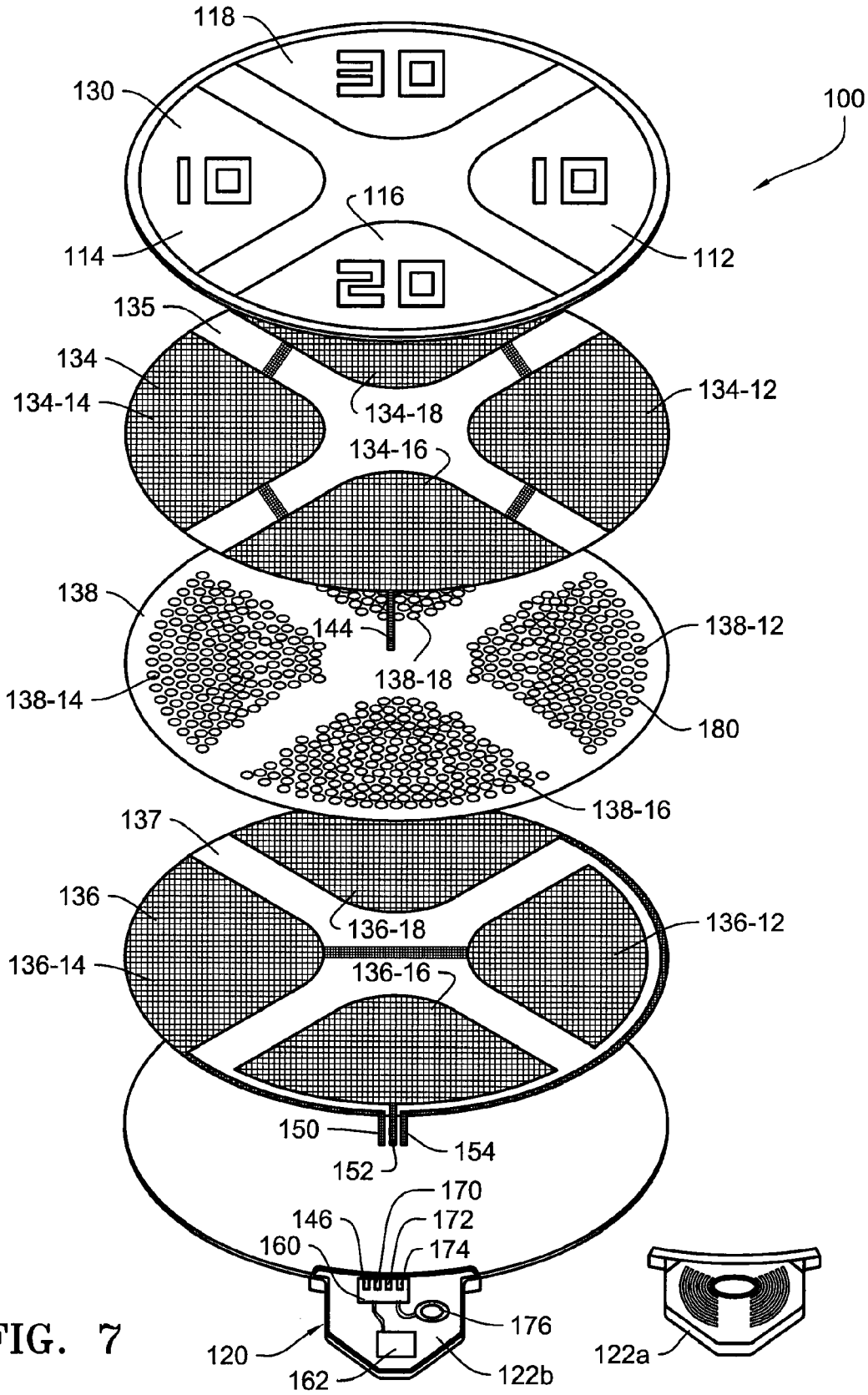
FIG. 7 is an exploded perspective view of the electronic target of FIG. 6.

Referring to FIG. 7, which is an exploded perspective view of the embodiment of FIG. 6, the electronic target 100 includes a top surface layer 130 and a bottom surface layer 132. The top surface layer 130 is made non-electrically conductive material, such as plastic sheeting, nylon or other suitable material that is preferably weather resistant, remains color fast so the colors will not appreciably fade when exposed to sunlight or ultraviolet light, and which is suitable for printing for purposes of designating the scoring areas 112, 114, 116, 118 and the associated point values or other indicia as previously discussed. The bottom surface layer 132 is made of non-electrically conductive material such as foam rubber or other suitable material that is preferably weather resistant, minimizes sliding of the target with respect to the ground or a floor surface (when used indoors) upon impact by the darts 10, and which will preferably absorb some of the impact of the dart 10 to reduce the tendency of the dart 10 from bouncing after impact.

Between the top and bottom surface layers 130, 132 is an upper electrically conductive layer 134 and a lower electrically conductive layer 136, separated by a perforate, non-electrically conductive middle layer 138.

Figure 8:
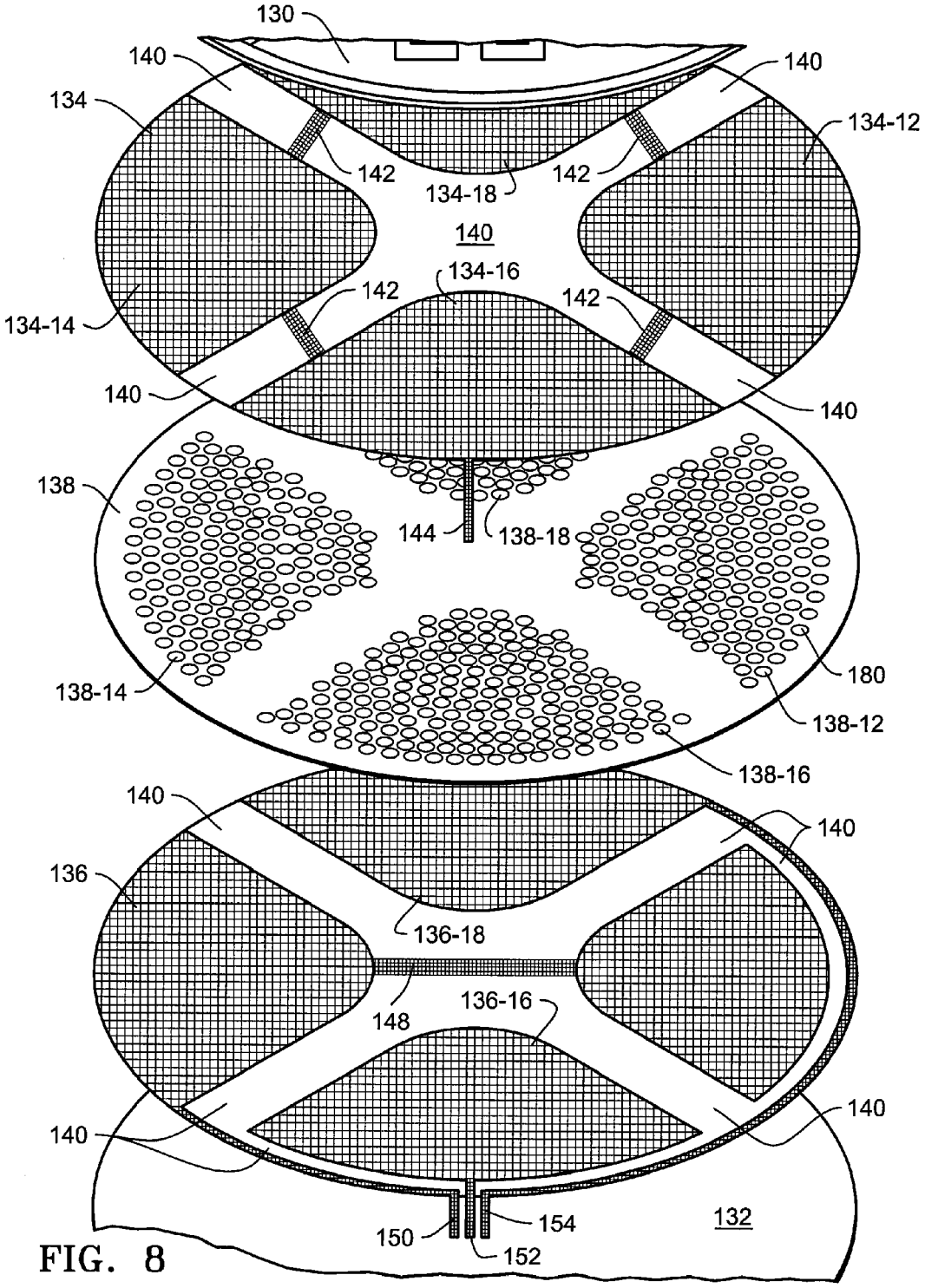
FIG. 8 is enlarged view of a portion of the exploded perspective view of FIG. 7.

The upper electrically conductive layer 134 may be comprised of non-electrically conductive plastic foil 135 on which an electrically conductive material is printed or applied on the bottom face of the foil 135 in areas (designated by reference numerals 134-12, 134-14, 134-16, and 134-18) which generally align with scoring areas 112, 114, 116, 118 of the top surface layer 130. As best viewed in FIG. 8, which is an enlarged view of the embodiment of FIG. 7, the electrically conductive areas 134-12, 134-14, 134-16, 134-18 are electrically insulated from one another by non-electrically conductive areas 140 of the foil 135. However, jumpers 142 of electrically conductive material are printed or applied to the foil 135 on the bottom face to electrically connect the conductive areas 134-12, 134-14, 134-16, 134-18. In an alternative embodiment the entire bottom face of the foil 135 may be covered with electrically conductive material. An upper connection lead 144 is printed or applied on the bottom face of the foil 135 to electrically connect the conductive areas 134-12, 134-14, 134-16, 134-18 to an upper lead 146 on a circuit board 160 of the controller 120 which is electrically connected to a battery or other electric power source 162.

The lower electrically conductive layer 136 is preferably comprised of a non-electrically conductive plastic foil 137 on which an electrically conductive material is printed or applied on the top face of the foil 137 in areas (designated by reference numerals 136-12, 136-14, 136-16, and 136-18) which generally align with the score areas 112, 114, 116, 118 of the top surface layer 130. As best viewed in FIG. 8, the conductive areas 136-12, 136-14, 136-16, 136-18 are electrically insulated from one another by non-electrically conductive areas 140 of the foil 137. It should be observed, however, that in the embodiment shown, a jumper 148 of electrically conductive material is printed or applied to the top face of the foil 137 to electrically connect the two "10" point scoring areas 136-12, 136-14. Of course, if the electronic target 100 did not have scoring areas with the same point value, a jumper 148 would not be desired for reasons that will be evident later. Lower connection leads 150, 152, 154 of electrically conductive material are also printed or applied to the top face of the foil 137 to electrically connect each of the conductive areas 136-12, 136-14, 136-16, 136-18 on the foil to corresponding lower leads 170, 172, 174 on the circuit board 160 of the controller 120 and the battery or other electric power source 162.

The perforate, non-electrically conductive middle layer 138 is disposed between the bottom face of the upper conductive layer 134 and the top face of the lower conductive layer 136 thereby electrically insulating the upper and lower conductive layers 134, 136. The perforate, non-conductive middle layer 138 includes a plurality of apertures 180 in perforate areas 138-12, 138-14, 138-16, 138-18 in general alignment with the corresponding scoring areas 112, 114, 116, 118 of the top surface layer 130. The perforate, non-conductive middle layer 138 is preferably made of a foam material or other compressible material.

Thus, it should be appreciated that during game play, if a dart 10 lands in a scoring area 112, 114, 116, 118 of the target 100, the impact of the dart 10 will cause the perforate, non-conductive middle layer 138 to compress (if compressible) allowing the upper electrically conductive layer 134 to make contact with the lower electrically conductive layer 136 at the point of contact through the apertures 180, thereby completing the electrical circuit to generate an electrical signal which is received by the circuit board 160 of the controller 120. The circuit board includes the appropriate circuitry, as recognized by those of skill in the art, to cause the speaker 176 disposed between the upper and lower housing members 122*a*, 122*b* (FIG. 7) of the controller 120 to produce audio output. For example, the controller 120 may include recordings of a voice speaking or verbalizing the point values associated with the scoring areas 112, 114, 116, 118 or the controller may produce a synthesized verbalization of the point values. Alternatively, a distinct sound or tone may be generated for each of the scoring areas.

The electronic target 100 is ideally designed to only generate a signal to produce audio or visual output when the weighted end of the dart 10 hits first within a scoring area to better simulate the "old" lawn dart game with the pointed metal tip, where points were scored only if the dart stuck in the ground within the hoop. Thus, if the dart 10 is thrown such that it lands on its side or bounces into the target sufficient impact to the scoring areas will not be produced to generate a signal to cause the controller 120 to produce the audio and/or visual output. Likewise, if the dart bounces within the target and hits multiple scoring areas, only the first impact will be sufficient to generate an electrical signal. Of course, if desired, the electronic target 100 could also be designed to generate a signal and produce audio and/or visual output upon the dart 10 landing and/or bouncing into the target by, for example, making the apertures 180 within the middle layer 138 larger and/or by decreasing the thickness of the middle layer 138 and/or by providing a more easily compressible material.

To play the lawn dart game using the electronic target 100, the electronic target 100 is placed on the ground (or floor if playing indoors). A foul line is selected a desired distance from the target (for example 10, 20 or 30 feet away). Each player is given a set of darts 10 to throw. Each players set of darts are preferably a different color to allow the players to distinguish between each other's darts when they are thrown toward the target. The first player stands behind the foul line and throws the dart underhanded one-at-a-time toward the target. If the dart hits within one of the scoring areas of the target, the audio signal is produced corresponding to that scoring area. After the first player finishes throwing his/her set of darts, it is the second players turn. When both players have finished throwing their darts, the players retrieve their darts and continue the next round of play. Each player keeps track of and adds the points called out by the controller during his/her turn and during each round of play until one of the players reaches a predetermined score, such as 100 or 200 points.

Rather than the players manually keeping track of their respective points during game play, the controller 120 may be programmed to track and total the points scored by each player during that player's turn. For example, in one embodiment, a radio frequency identification (RFID) tag or other tracking device, as would be recognized and understood by those of skill in the art, may be incorporated into the darts 10 to electronically distinguish between each player's set of darts. When a dart associated with one of the RFID tags impacts within the scoring area of the target, the point value corresponding to that scoring area is associated with that RFID tag, is stored in memory, and added to the point total for that player. In such an embodiment, the point total may be displayed on a display incorporated into the controller housing 122. The electronic circuitry and components for such a system would be readily understood by those of skill in the art and therefore further discussion or description is not warranted.

As mentioned above, if visual output is desired alone or in addition to audio output, the electronic target 100 could incorporate LEDs, a visual display screen, or other visual indicators which light up or display upon the dart impacting the scoring areas. The electronic circuitry and components for providing such a audio and/or visual output would be readily understood by those of skill in the art and therefore further discussion or description is not warranted.

In addition, the controller 122 may incorporate a wireless communication components to transmit audio and/or visual output to a remote scorekeeping device 110 as shown in FIG.

9. The remote scorekeeping device 110 may comprise a single free standing scoreboard positioned for view by the players or the remote scorekeeping device 110 may comprise two separate scoreboards, each associated with one of the targets. In yet another alternative embodiment, the remote scorekeeping device 110 may comprise one or two devices worn by a player on each team. The electronic circuitry and components for providing wireless communication with a remote scorekeeper device and the associated audio and/or visual output would be readily understood by those of skill in the art and therefore further discussion or description is not warranted.

Figure 9:
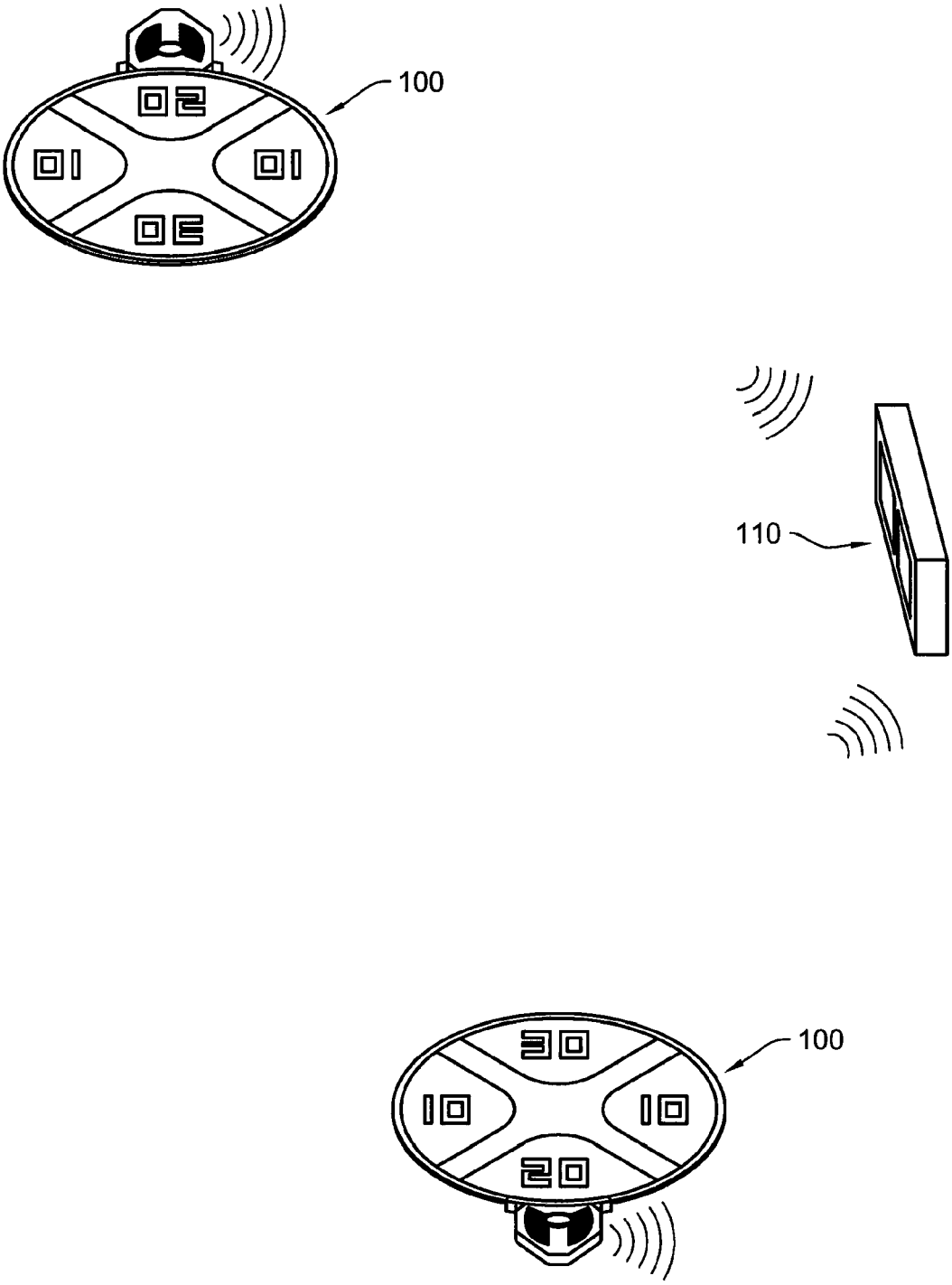
FIG. 9 is a perspective view of a dart game with electronic targets wirelessly communicating with a score keeping device.
Figure 10:
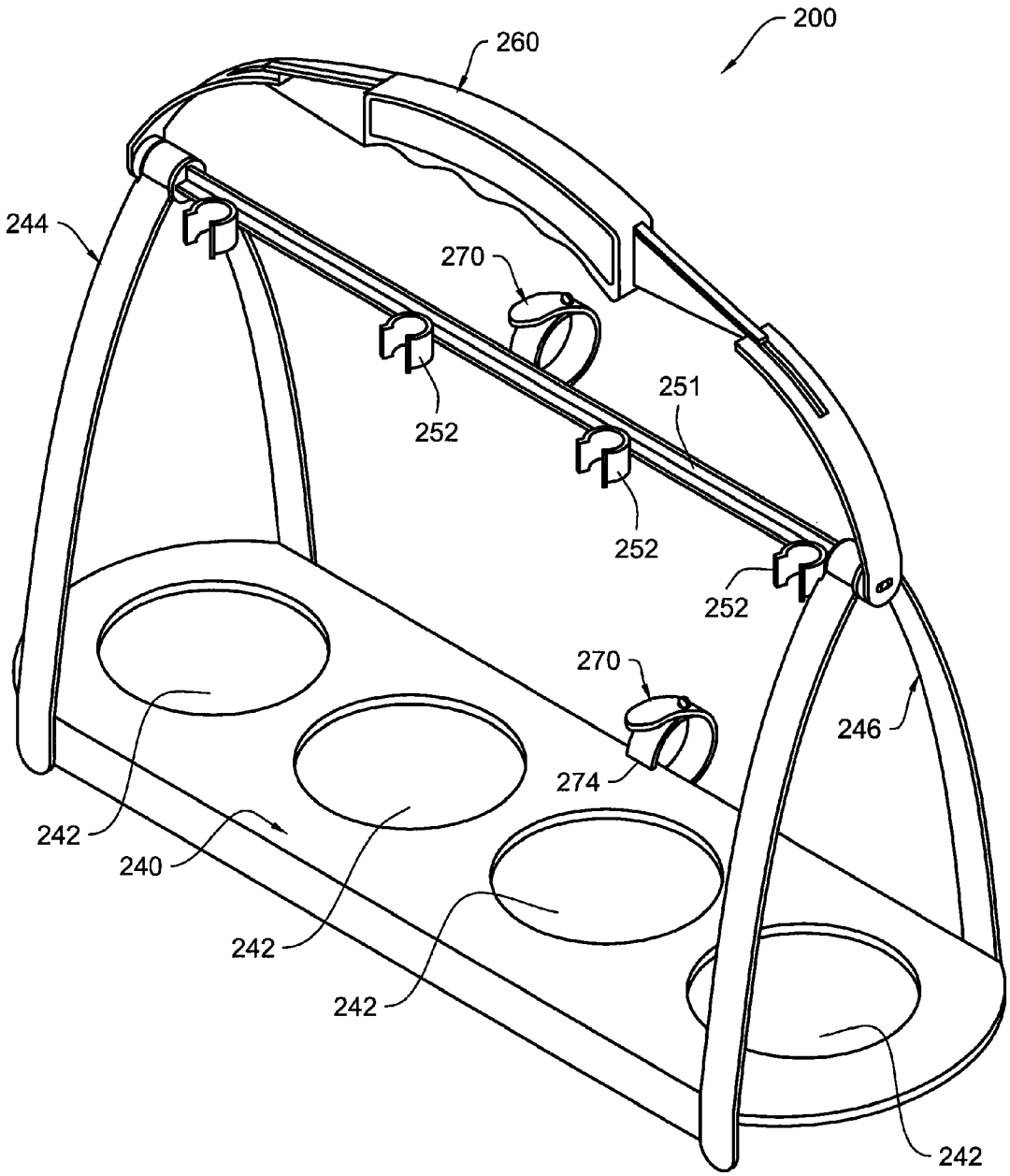
FIG. 10 is a perspective view of one embodiment of a lawn dart caddy.

FIG. 10 is a perspective view of one embodiment of a lawn dart caddy designated generally by reference numeral 200. FIG. 10, is a perspective view of the lawn dart caddy of FIG. 9 showing the blunt headed or "safety" lawn darts 10 and the coiled target hoop 100 being carried and stored by the caddy 200.

As previously discussed, the lawn darts 10 include a head 22 having a rounded or hemispherical base 24. The head 22 is attached to a shaft 14 having a plurality of outwardly extending fins 19. The target hoop 100 is typically constructed of plastic and is shown in a coiled position. During game play the target hoop 100 is uncoiled such that it has a substantially larger diameter than when in the coiled storage position. Alternatively, the electronic target 100 is placed on the ground (or floor if playing indoors). Similar to the target hoop 100 the electronic target 100 may also be configured in a storage position that is a substantially smaller diameter than the play position.

The caddy 200 includes a base 240 with a series of holes 242 sized to receive the rounded base 24 of the lawn dart heads 22. The holes 242 are spaced sufficiently to receive the dart heads 22 without interference or obstruction with adjacent heads. Left and right supports, 244, 246 support a lawn dart shaft restraint member 250 vertically above the base 240. The lawn dart shaft restraint member 250 may comprise a horizontal bar 251 with a plurality of clips 252 to frictionally receive and restrain the shafts 14 of the darts 10. A handle 260 extends from one end of the bar 251 to the other to provide a convenient means for carrying the assembly.

Figure 11:
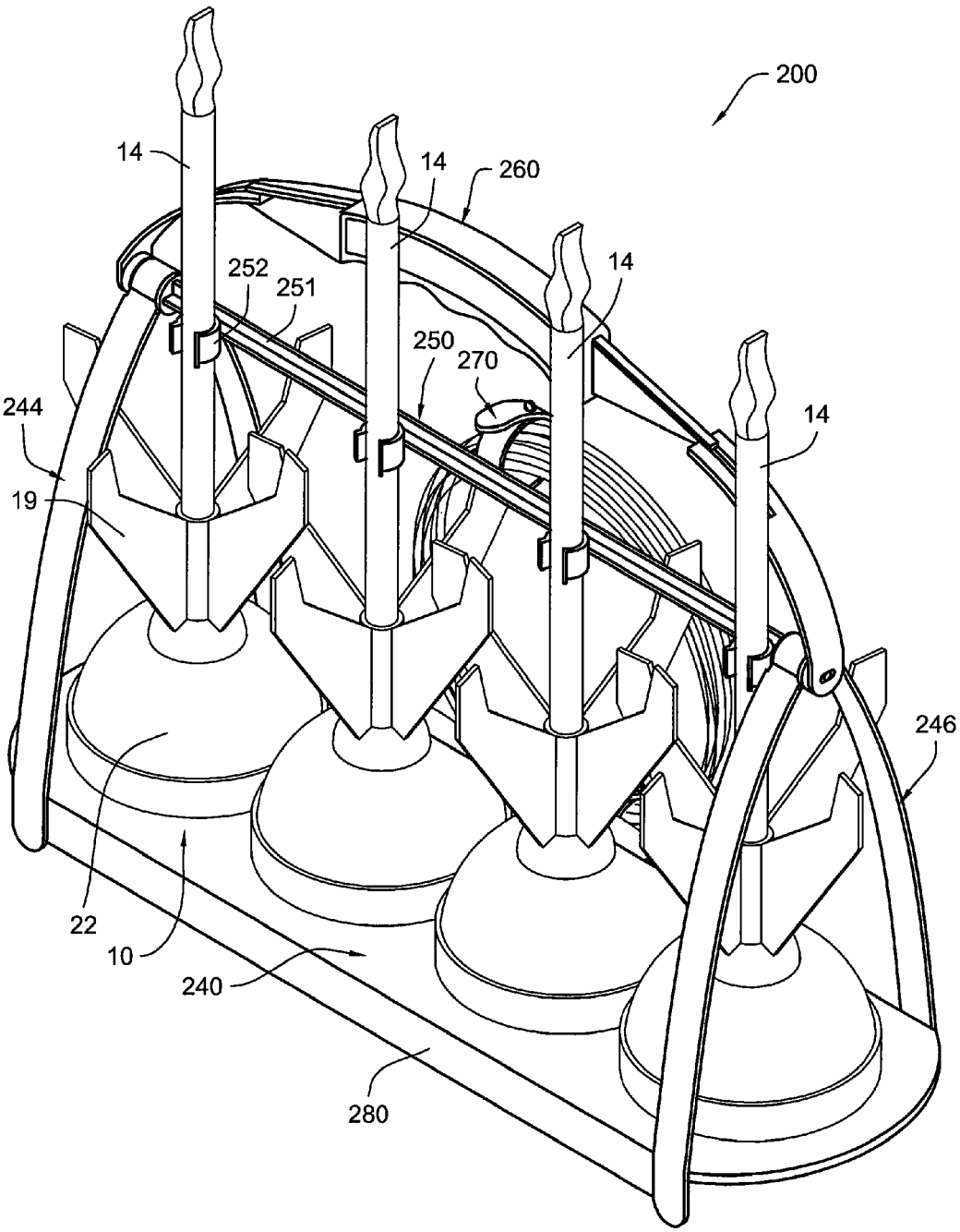
FIG. 11 is a perspective view of the lawn dart caddy of FIG. 10 showing the lawn darts and coiled target hoop being carried and stored by the caddy.
Figure 14:
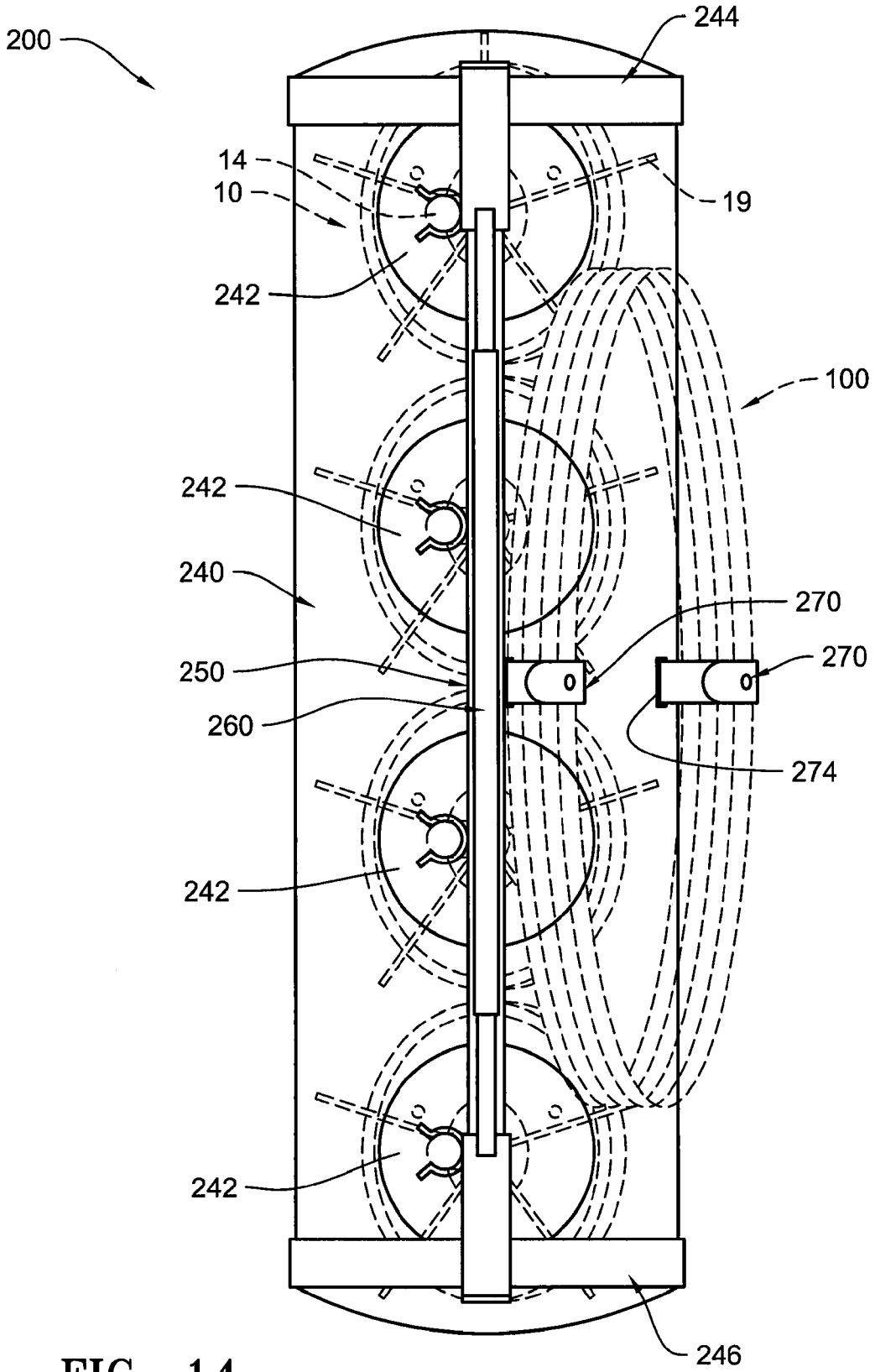
FIG. 14 is a top plan view of the lawn dart caddy of FIG. 10 with the lawn darts and coiled target hoop shown in hidden lines.
Figure 15:
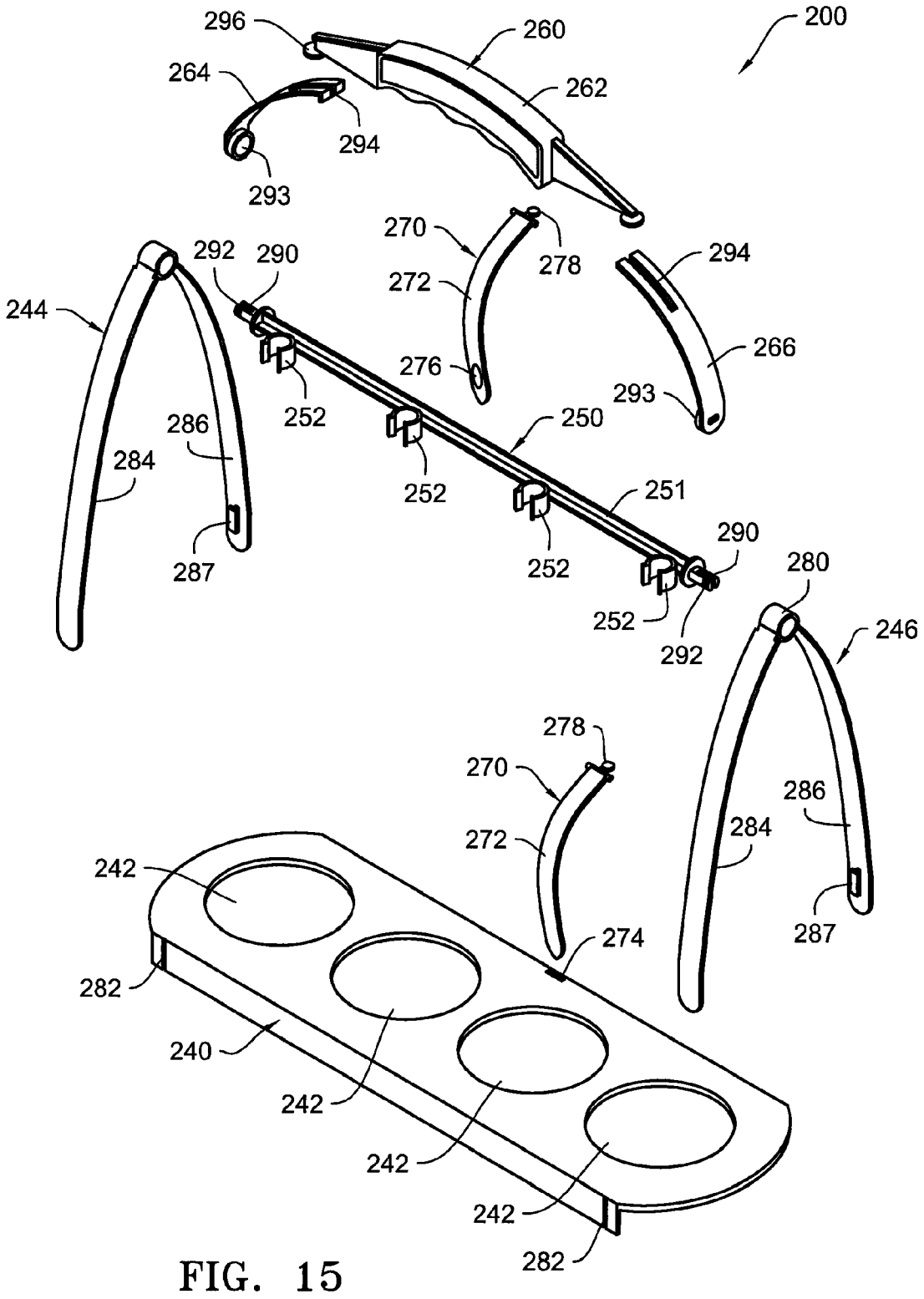
FIG. 15 is an exploded perspective view of the lawn dart caddy of FIG. 10.

A target hoop restraint 270 is provided for holding and restraining the target hoop 100 in a coiled storage position (see FIGS. 11, 13 and 14). In one embodiment, the target hoop restraint 270 may comprise a pair of straps 272 attached to the caddy 200. In a preferred embodiment, one of the straps 272 may attach to the base 240 by extending through a slot 274 (FIGS. 10 and 15) in the base 240. Although not visible in the drawing figures, a similar slot 274 may be provided in the horizontal bar 251 for receiving the other strap 272. Referring to FIG. 15, which is an exploded perspective view of an embodiment of the dart caddy 200, one end of the strap 272 is preferably enlarged so that it will not pull through the slots 274. The straps 272 may include an aperture 276 proximate one end of the strap which is sized to receive a head 278 on the other end of the strap 272. The target hoop 100 is secured to the caddy by wrapping the straps 272 around the coiled target hoop 100 and inserting the head 278 through the aperture 276.

Continuing to refer to FIG. 15, the base 240 includes downwardly extending flanges 280 which provide structural rigidity to the base 240. The flanges 280 include vertical channels 282 proximate each end. Each of the bar supports 244, 246 comprise two legs 284, 286 which connect to a tube 288 at an upper end. Proximate the lower ends of each of the legs 284, 286 is a T-shaped ear 287. The T-shaped ear 287 of each leg 284, 286 of the bar supports 244, 246 is received within the channel 282 at each end of the flange 280, thereby joining the bar supports 244, 246 at each end of the base 240. The horizontal bar 251 includes a post 290 at each end which extends through the respective tubes 288. The posts 290 include a split 292 to allow the posts to be compressed and frictionally received within sockets 293 at each end of the handle 260. The handle 260 includes a middle section 262 and end sections 264, 266. Each of the end sections 264, 266 include a channel 294, which slidably receive an enlarged disc 296 at each end of the middle section 262. The channel 294 and disc 296 cooperate to allow the middle section 262 of the handle 260 to move with respect to the end sections 264, 266 such that the handle 260 can be compressed so it will not extend appreciably above the ends of the lawn darts, thereby allowing the caddy 200, the lawn darts 10 and the coiled hoop to fit into a smaller package for shipping, minimize shelf space at retail outlets and take up reduced space when not in use. When the caddy 200 is being carried, the middle section 262 of the handle 260 will extend with respect to the end sections 264, 266. The various components of the caddy 200 as identified above are preferably made of plastic such that the caddy 200 is lightweight and the components are somewhat deformable and resilient.

Figure 16:
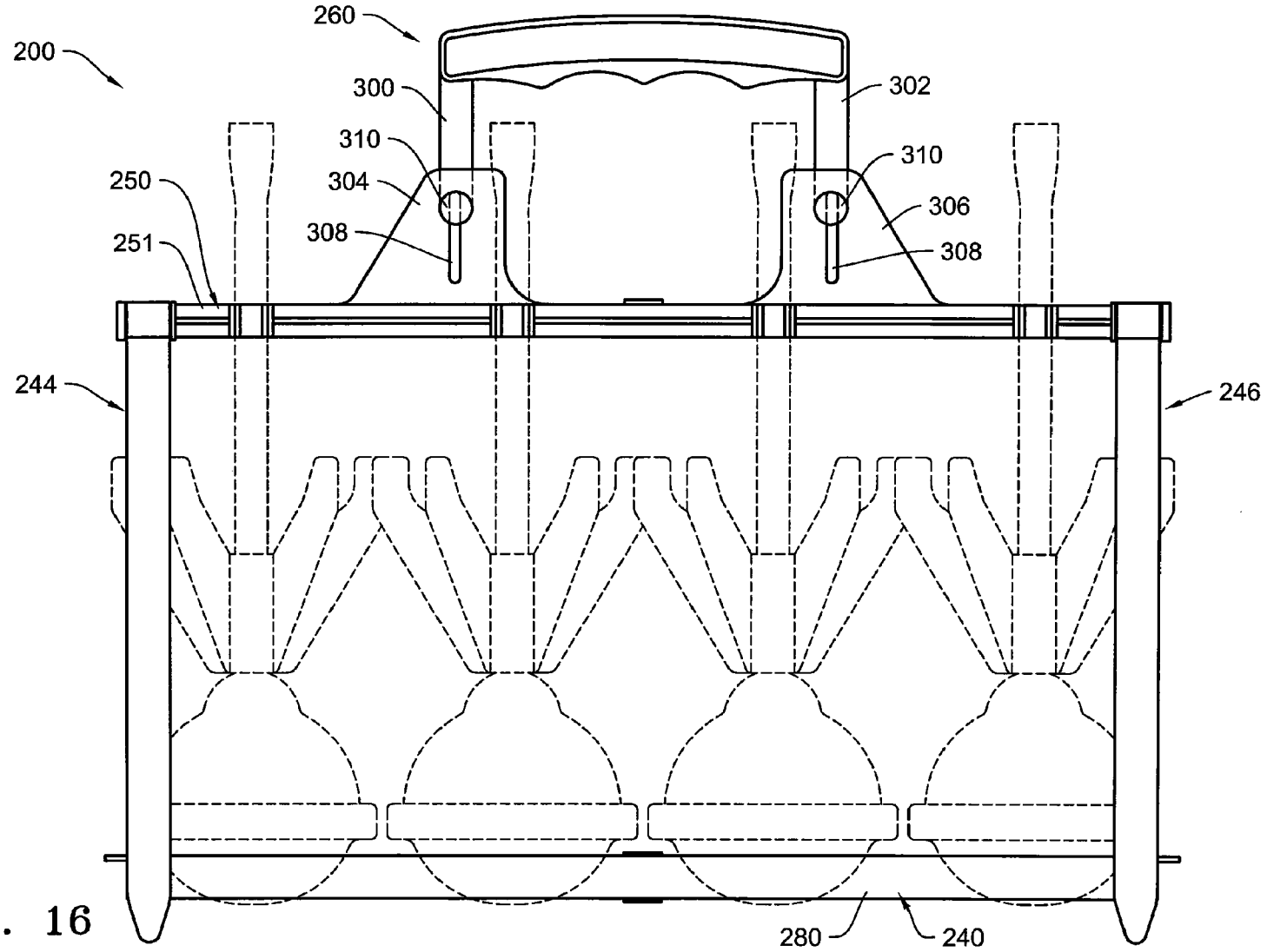
FIG. 16 is a front elevation view of an alternative embodiment of a lawn dart caddy.

FIG. 16 is a front elevation view of another embodiment of the dart caddy 200. In this embodiment the caddy 200 is substantially the same as the caddy described in connection with FIGS. 10-15 except for the handle. In this embodiment, the handle 260 includes rigid downerardly extending legs 300, 302, which align with mating ears 304, 306 projecting upwardly from the horizontal bar 251 of the dart shaft restraint member 250. The ears 304, 306 include vertical slots 308. Discs 310 project from the ends of the legs 300, 302 and are received through the slots 308. It should be appreciated that the legs 300, 302 are movable with respect to the ears 304, 306 as the discs 310 slide with respect to the slots 308 thereby permitting the handle 260 to move vertically up and down. Thus, as in the previous embodiment, the handle 260 can be compressed so it will not extend appreciably above the ends of the lawn darts, thereby allowing the caddy 200 (together with the lawn darts 10 and the coiled hoop to fit into a smaller package for shipping, minimize shelf space at retail outlets and take up reduced space when not in use. Also as in the previous embodiment, when the caddy 200 is being carried, the handle 260 will extend with respect to the horizontal bar 251.

The foregoing description is presented to enable one of ordinary skill in the art to make and use the invention and is provided in the context of a patent application and its requirements. Various modifications to the preferred embodiment of the apparatus, and the general principles and features of the system and methods described herein will be readily apparent to those of skill in the art. Thus, the present invention is not to be limited to the embodiments of the apparatus, system and methods described above and illustrated in the drawing figures, but is to be accorded the widest scope consistent with the spirit and scope of the appended claims.

The invention claimed is:

1. A lawn dart game, comprising:

(a) a plurality of lawn darts, each lawn dart comprising:

(i) an elongated shaft having a first end and a second end;

(ii) a plurality of flights extending outwardly from the shaft between the first and second ends; and (iii) a rounded head attached to the second end of said shaft, wherein said rounded head comprises:

A. an upper head portion secured proximate said second end of said elongated shaft;

B. a lower rounded head portion secured to said upper head portion, and

C. a weight received between said upper head portion and said lower rounded head portion;

(b) a caddy, comprising:

(i) a base having a plurality of rounded recesses formed in an upper surface of said base to matingly receive said lower rounded head portion of said plurality of lawn darts;

(ii) a plurality of shaft restraints disposed a distance vertically above said base, said plurality of shaft restraints each restraining one of said shafts of said plurality of lawn darts; and (iii) a handle sized and configured for receiving a hand of a user;

wherein said rounded recesses of said base and said shaft restraints cooperate to retain each of said plurality of lawn darts received therein such that a user may carry said caddy together with said plurality of lawn darts together as a unit by grasping said handle with a hand.

2. The lawn dart game of claim 1, wherein a portion of said rounded head is resilient.

3. The lawn dart game of claim 2, wherein said upper head portion is non-resilient, and wherein said lower head portion is resilient.

4. The lawn dart game of claim 1, further comprising:

a spring disposed within said rounded head, said spring biasing said weight axially away from said upper head portion.

5. The lawn dart game of claim 1 further comprising at least one target hoop.

6. The lawn dart game of claim 1 further comprising at least one electronic target.

7. The lawn dart game of claim 6 wherein said electronic target further comprises:

a controller adapted to produce output in response to an electrical signal;

a top surface layer having at least one scoring area; a bottom surface layer;

an upper layer having an electrically conductive area in general alignment with said at least one scoring area of said top surface layer, said electrically conductive area electrically connected to a electric source;

a lower layer having an electrically conductive area in general alignment with said at least one scoring area of said top surface layer, said electrically conductive area electrically connected to said electric source;

a non-electrically conductive middle layer disposed between and electrically insulating said electrically conductive areas of said upper and lower layers, said non-electrically conductive middle layer having a plurality of apertures in an area in general alignment with said at least one scoring area of said top surface layer;

whereby upon application of a force at a point within said at least one scoring area of said top surface layer, said upper electrically conductive layer is caused to come into contact with said lower electrically conductive layer through at least one of said plurality of apertures, generating said electrical signal and causing said controller to produce said output.

8. The lawn dart game of claim 7 wherein said output is audio output.

9. The lawn dart game of claim 7 wherein said output is visual output.

10. The lawn dart game of claim 7 wherein said top surface layer comprises a plurality of defined scoring areas each associated with assigned point values.

11. The lawn dart game of claim 7 wherein said output is audio output corresponding to said assigned point value of said scoring area to which said force is applied.

12. The lawn dart game of claim 7 wherein said output is visual output corresponding to said assigned point value of said scoring area to which said force is applied.

13. A lawn dart game, comprising:

(a) a plurality of lawn darts, each lawn dart comprising:

(i) an elongated shaft having a first end and a second end;

(ii) a plurality of flights extending outwardly from the shaft between the first and second ends; and (iii) a rounded head attached to the second end of said shaft;

(b) a caddy, comprising:

(i) a base;

(ii) a plurality of shaft restraints disposed a distance vertically above said base, said plurality of shaft restraints each restraining one of said shafts of said plurality of lawn darts;

(iii) a handle sized and configured for receiving a hand of a user; and (iv) a target hoop restraint;

(c) at least one target hoop;

wherein said shaft restraints cooperate to retain said lawn darts received therein and wherein said target hoop restraint retains said at least one target hoop such that a user may carry said caddy together with said plurality of lawn darts and said at least one target hoop together as a unit by grasping said handle with a hand.

14. The lawn dart game of claim 13 further comprising at least one electronic target.

15. The lawn dart game of claim 14 wherein said electronic target further comprises:

a controller adapted to produce output in response to an electrical signal;

a top surface layer having at least one scoring area; a bottom surface layer;

an upper layer having an electrically conductive area in general alignment with said at least one scoring area of said top surface layer, said electrically conductive area electrically connected to a electric source;

a lower layer having an electrically conductive area in general alignment with said at least one scoring area of said top surface layer, said electrically conductive area electrically connected to said electric source;

a non-electrically conductive middle layer disposed between and electrically insulating said electrically conductive areas of said upper and lower layers, said non-electrically conductive middle layer having a plurality of apertures in an area in general alignment with said at least one scoring area of said top surface layer;

whereby upon application of a force at a point within said at least one scoring area of said top surface layer, said upper electrically conductive layer is caused to come into contact with said lower electrically conductive layer through at least one of said plurality of apertures, generating said electrical signal and causing said controller to produce said output.

16. The lawn dart game of claim 15 wherein said top surface layer comprises a plurality of defined scoring areas each associated with assigned point values.

* * * * *